US008291608B2

(12) United States Patent
Fogle

(10) Patent No.: US 8,291,608 B2
(45) Date of Patent: Oct. 23, 2012

(54) ENGINE OIL CAP PROTECTOR

(76) Inventor: Kurt Karl Fogle, Painesville, OH (US)

( * ) Notice: Subject to any disclaimer, the term of this patent is extended or adjusted under 35 U.S.C. 154(b) by 696 days.

(21) Appl. No.: 12/534,146

(22) Filed: Aug. 2, 2009

(65) Prior Publication Data

US 2010/0187232 A1 Jul. 29, 2010

Related U.S. Application Data

(60) Provisional application No. 61/147,116, filed on Jan. 25, 2009.

(51) Int. Cl.
*G01F 23/04* (2006.01)

(52) U.S. Cl. ..... 33/728; D12/197

(58) Field of Classification Search ..... 33/722, 33/728; 70/158, 163; 220/DIG. 33; D12/197
See application file for complete search history.

(56) References Cited

U.S. PATENT DOCUMENTS

D202,417 S * 9/1965 Hurt ..... D12/197
3,316,647 A * 5/1967 Swallert ..... 33/722
3,349,947 A * 10/1967 Zumwalt ..... 70/158
4,132,091 A * 1/1979 Aro et al. ..... 70/165
4,825,669 A * 5/1989 Herrera ..... 70/163
5,613,303 A * 3/1997 Kayano et al. ..... 33/722
5,908,130 A * 6/1999 Chang ..... 220/254.4
D567,728 S * 4/2008 Huston ..... D12/197
2006/0000103 A1* 1/2006 Nicosia et al. ..... 33/722
2006/0168757 A1* 8/2006 Duning et al. ..... 16/49
2010/0319415 A1* 12/2010 DeWalch ..... 70/158
2012/0024415 A1* 2/2012 Molloy ..... 138/96 R

* cited by examiner

*Primary Examiner* — G. Bradley Bennett
(74) *Attorney, Agent, or Firm* — Michael Ries

(57) ABSTRACT

A locking cap for closing the oil fill opening of the crank case in a motorcycle engine. The cap has only three major members. A first member has an upper grip portion and a lower portion with openings located in the lower portion for holding ball bearings. A second member is located within the first member and is rotatably coupled to the first member. A lock mechanism attached to the first and second members rotates the second member relative to the first member as the lock mechanism is operated to urge the ball bearings to move through the openings in the first member as the second member is rotated in a first direction relative to the first member. A third member attached to the second member provides support for a dip stick.

18 Claims, 6 Drawing Sheets

ENGINE OIL CAP PROTECTOR

REFERENCE TO RELATED APPLICATIONS

This patent application claims the benefit of U.S. Provisional Application No. 61/147,116 filed on Jan. 25, 2009, the disclosure of which is incorporated herein in its entirety by reference.

BACKGROUND OF THE INVENTION

1. Field of the Invention

The present invention relates generally to motor cycles and more particularly to a locking cap for the engine crank case of a motorcycle where a key is used to enable disengagement and removal of the cap.

2. Description of Related Art

Conventional mechanisms for locking a motorcycle's crank case cap have several disadvantages. Conventional crank case caps require that a key is turned in a lock in one direction, usually counterclockwise to unlock the cap. The key must thereafter be turned in the opposite direction to lock the cap to the fuel tank inlet. Thus, the cap is usually rotated counterclockwise with the key in the lock and rotated in the opposite direction, also with the key in the lock. This required rotation of the cap is particularly cumbersome and awkward since the cap key is typically carried as a part of a key ring or chain and the crank case cap is normally on a part of the motorcycle that is not readily accessible. Thus, on a motorcycle, it is not convenient, when adding oil or checking the level of the oil in the crank case, to loosen and tighten the cap by turning it with a key in the lock. An alternative method of removing the crank case cap is to first unlock the cap, then remove the key from the lock, twist the cap to remove it from the crank case, check or add oil to the crank case, and then replace the cap by twisting it onto the crank case inlet. Now the key is again inserted to lock the cap in position. This also is inconvenient in that it requires the cap to be turned again to complete the procedure.

It is an object of the present invention to provide a locking crank case oil tank cap for a motorcycle that can be removed and replaced without twisting. Thus, removing and replacing the cap is more easily done because it does not have to be turned either clockwise or counter-clockwise when removing or replacing the cap.

A further advantage of the present invention, as contrasted with other locking caps, is that only three major members are required, not including the key mechanism. The principal components are a cap with a key mechanism associated therewith, a rotatable member operatively connected to the key mechanism, and a third member coupled to the rotatable member for holding a dip stick. Other locking crank case caps for motorcycles require more major components.

SUMMARY OF THE INVENTION

There is disclosed a cap for closing the oil fill opening of the crank case in a motorcycle engine. The cap has only three major members. A first member has an upper grip portion and a lower portion with openings located in the lower portion for holding ball bearings. A second member is located within the first member and is rotatably coupled to the first member. A lock mechanism attached to the first and second members rotates the second member relative to the first member as the lock mechanism is operated to urge the ball bearings to move through the openings in the first member as the second member is rotated in a first direction relative to the first member. A third member attached to the second member provides support for a dip stick.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

Figure 1:
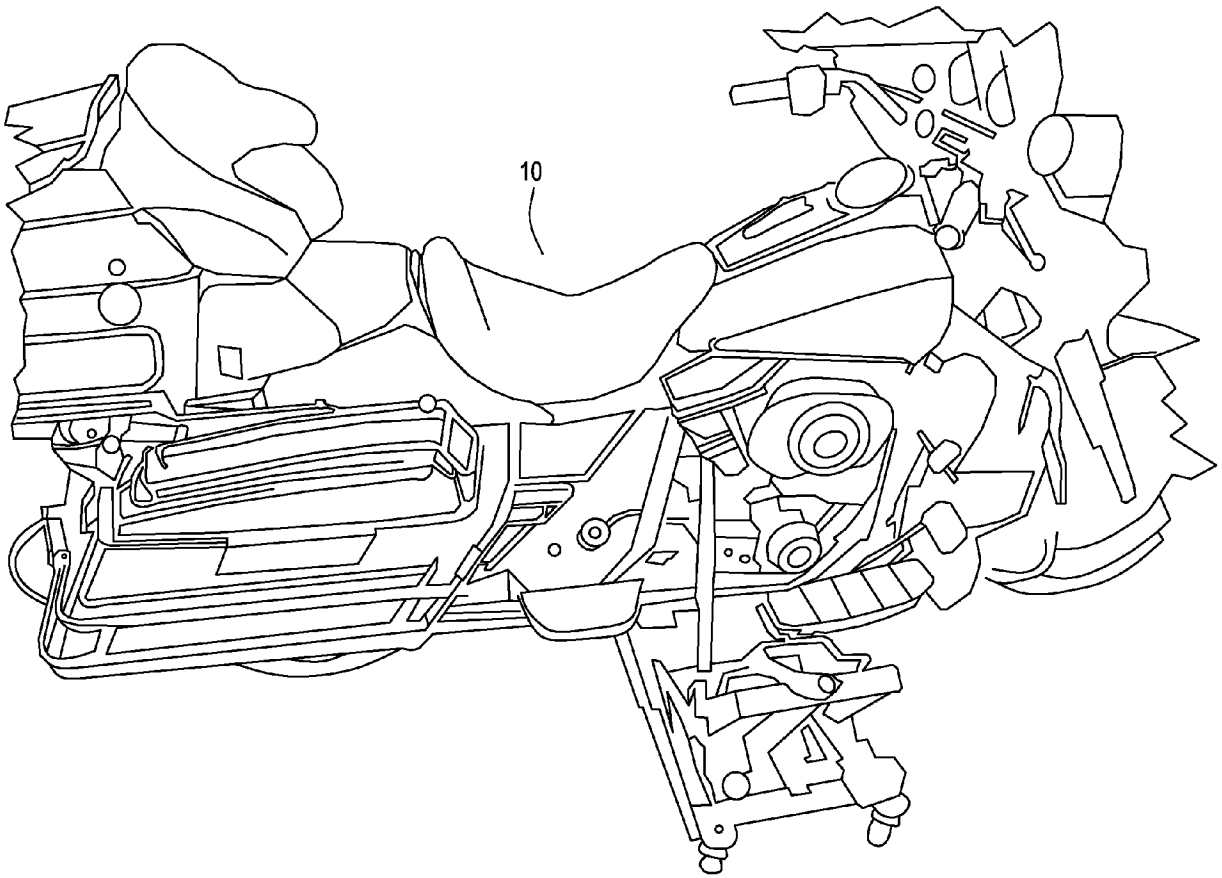
FIG. 1 is a right side view of a motorcycle with an arrow pointing to the location of the crank case oil cap.

Referring to FIG. 1, there is shown a side view of a motorcycle 10 having a frame that supports an engine/transmission assembly and front and rear wheels. The front wheel can turn left or right and can be used to steer the motorcycle. The rear wheel is coupled to the engine/transmission assembly that drives the rear wheel and includes a crank case having a crank case cover that includes an oil fill opening for receiving engine oil, and a cap used to cover the oil fill opening.

Figure 2:
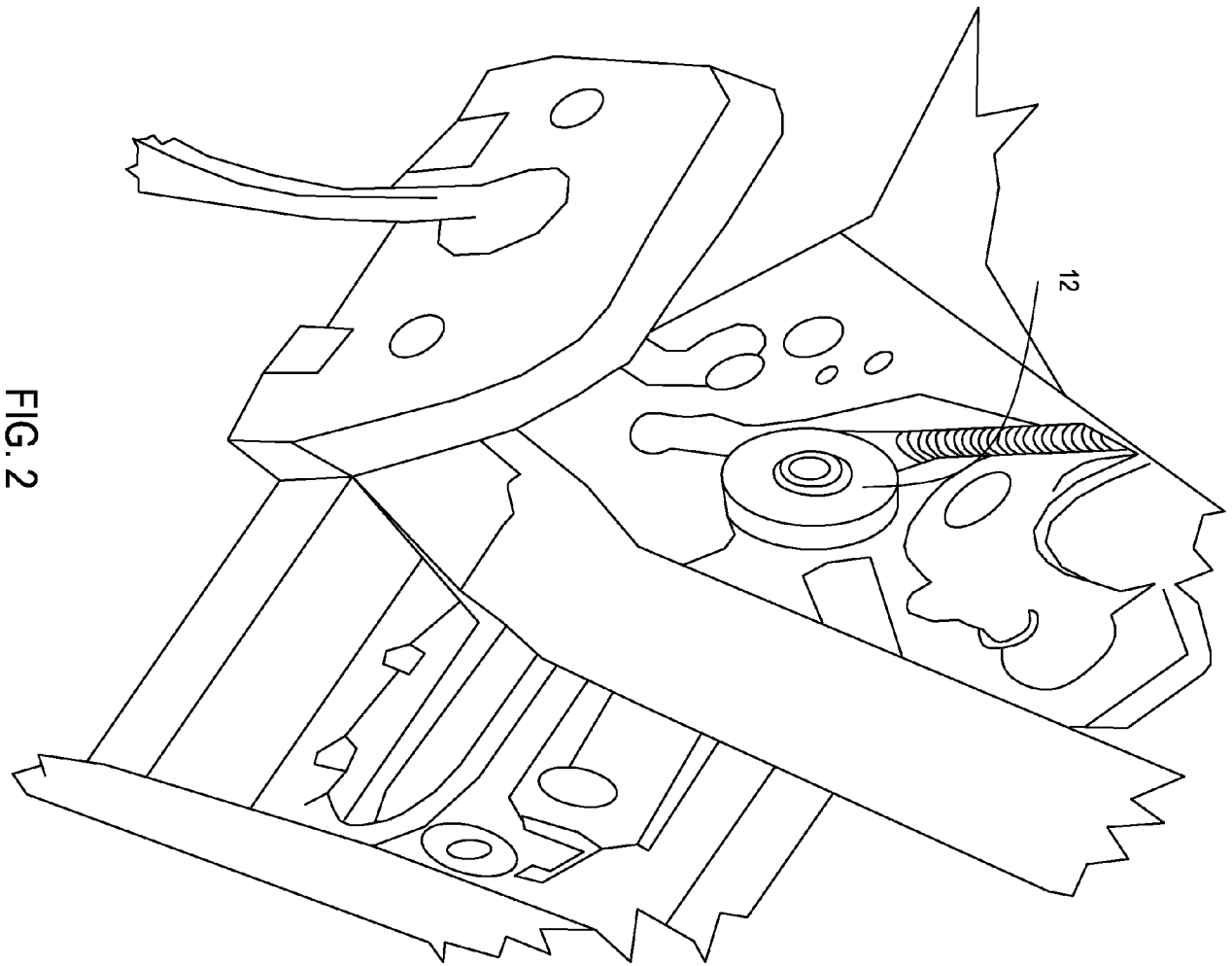
FIG. 2 is a close up view of the inventive crank case oil cap in place on the oil fill opening.

Referring to FIG. 2, there is shown is close up view of the crank case oil cap in place on the oil fill opening of the motorcycle crank case. Note that the oil fill cap is near the bottom of the motorcycle and an exhaust tube that can be very hot.

Figure 3:
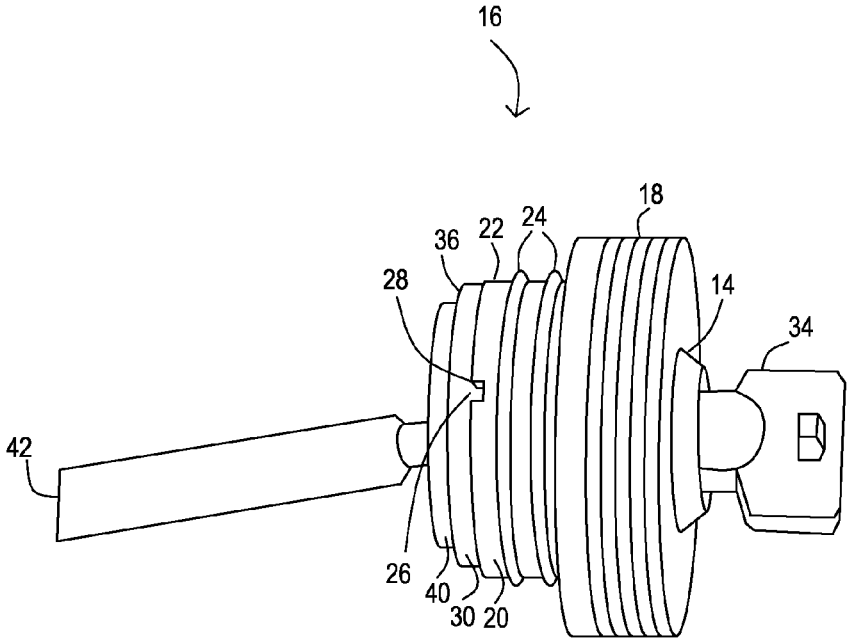
FIG. 3 is a side view of the crank case engine oil cap with a key in the locking mechanism and the dip stick extending from the bottom in accordance with the principles of the invention.

Referring to FIG. 3, there is shown a side view of the crank case engine oil cap with a key in the locking mechanism and the dip stick extending from the bottom in accordance with an embodiment of the invention. The cap includes a key mechanism 14 located in the body of a first member 16 having a large diameter hand grip top section 18 and a reduced diameter lower section 20. Lower section 20 supports two annular groves 22 for receiving O rings 24.

Located at the bottom of the lower section 20 are three openings 26 spaced apart 120 degrees for holding captive ball bearings 28 that are selectively urged to project out beyond the outer surface of the lower section.

Located within the lower section 20 of the first member 16 and having a flange 30 that protrudes beyond the bottom of the lower section is a second member 32. The second member 32 is connected to and urged by the key mechanism to rotate relative to the first member as the key 34 is turned.

Located within the second member and having a flange 36 that abuts the flange 30 of the second member is a third member 38. In this embodiment, the third member is pressed fit into the second member and rotates as a unit with the second member. The lower end 40 of the third member has a reduced diameter sized to be received by the oil fill opening of the crank case cover plate. Projecting out from an opening in the bottom of the third member is an oil dip stick 42.

Figure 4:
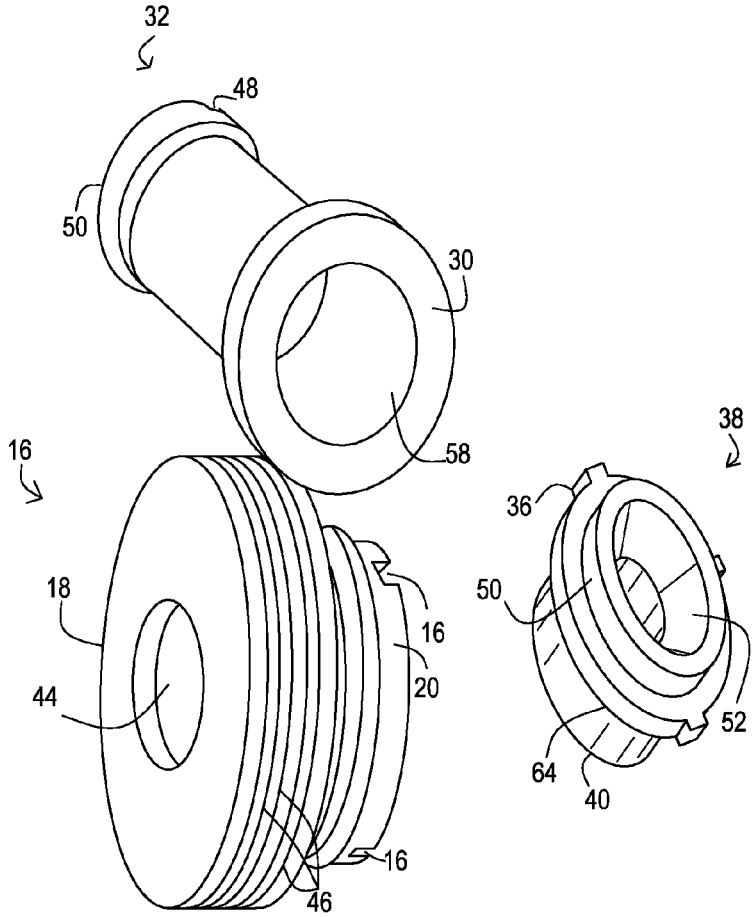
FIG. 4 is an isometric view of the three major members of the locking crank case oil cap without the key mechanism and the dipstick.

Looking at FIG. 4, there is shown an isometric view of the first member 16, the second member 32, and the third member 38 of the locking crank case oil cap. Referring to the first member 16, the top of the large diameter hand grip has a circular opening for receiving a key mechanism such as a cam lock. Located on the side surface of the hand grip top 18 are a plurality of evenly spaced grooves that are both ornamental and provide a certain amount of friction while removing and replacing the cap on the crank case oil fill opening. The bottom end of member 16 has three openings 26 spaced 120 degrees apart. Each opening 26 is in the side of a pocket that is sized to hold a ball bearing having a diameter of ⅛ of an inch. Each opening has a square or rectangular shape with at least one of the dimensions being slightly less than ⅛ of an inch to allow a ball bearing to project out beyond the outside surface of the lower section 20 but not pass through the opening 26.

The second member 32 fits within member 16 and has an O ring that provides an oil seal. The top end 50 of second member 32 has a wall with a opening configured and sized to be attached to the rotatable part of the cam lock with a nut. In operation, when a key is inserted into the lock mechanism and turned, the second member rotates relative to the first member. Located immediately behind the flange 30, and aligned with the openings 26 are ramps. As the second member is rotated relative to the first member, the ramps contact the ball bearings and urge them to move out beyond the outer surface of the lower section 20. Turning the second member in the other direction allows the ball bearings to move back into their pockets. Alignment and stop means are provided to align the ramps with the ball bearings and control the angular rotation of the second member relative to the first member.

Lower member 38 has a flange 36 with a first shoulder 40 of reduced diameter on one side and a second shoulder 50 of reduced diameter on the other side. Shoulder 40 is machined to have an annular grove for receiving an O ring 64. The O rings on the first, second, and third members are used to provide oil seals. The third member has an internal conical shaped chamber 52 for receiving a ball shaped end 54 of a dip stick 56 (see FIG. 6).

During assembly and after O rings have been place on the three members, a cam lock mechanism is inserted into the openings 44 in the first member, ball bearings are inserted into the pockets behind the openings 26, and the end of the second member having the O ring is inserted into the first member as it is properly aligned relative to the ball bearings and the flange on the second member contacts the bottom of the first member. At this time the second member is attached to the lock mechanism with a nut.

The inside of the second member is machined to have a cylindrical chamber that is sufficient to receive shoulder 50 of the third member, and then a conical shaped chamber 58 that corresponds to the conical shaped hamber in the third member.

After the second member is properly positioned in the first member and attached to the lock mechanism, the dip stick 56 is inserted through the opening in the third member with the ball residing in the conical chamber 52. Now the shoulder 50 of the third member is pressed fit into the opening 58 of the second member to lock the dip stick in the assembled cap.

Figure 5:
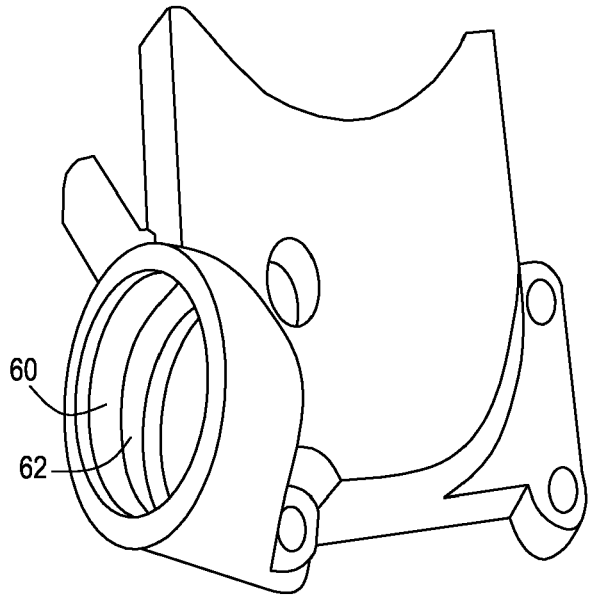
FIG. 5 is a isometric view of the crank case engine oil cap including a key and dip stick and a crank case cover showing the smooth bore of the oil inlet opening of the crank case cover.
Figure 5:
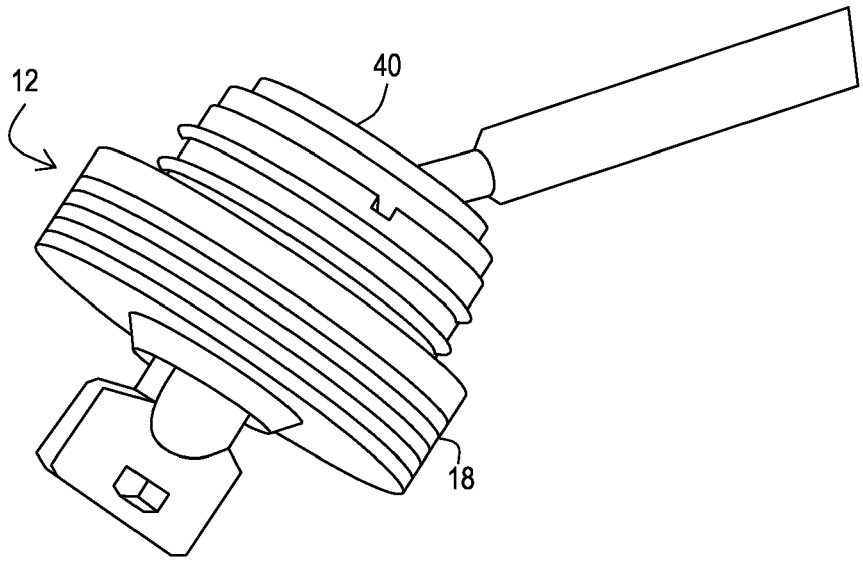

Referring to FIG. 5 there is shown an isometric view of the crank case engine oil cap including a key and dip stick and a crank case cover showing the smooth bore of the oil inlet opening of the crank case cover. In operation the dip stick end of the cap 12 is inserted into the oil fill opening 60 until the end 40 of the cap is in the opening 62 of the oil inlet opening. The user, holding the grip top of the first member with one hand, turns the key which urges the ball bearings to move out from the inside of the cap and press against the side wall of the oil inlet opening of the crank case cover to lock the cap to the oil fill opening. With the cap installed in the crank case cover, It is vandal and tamper proof.

Figure 6:
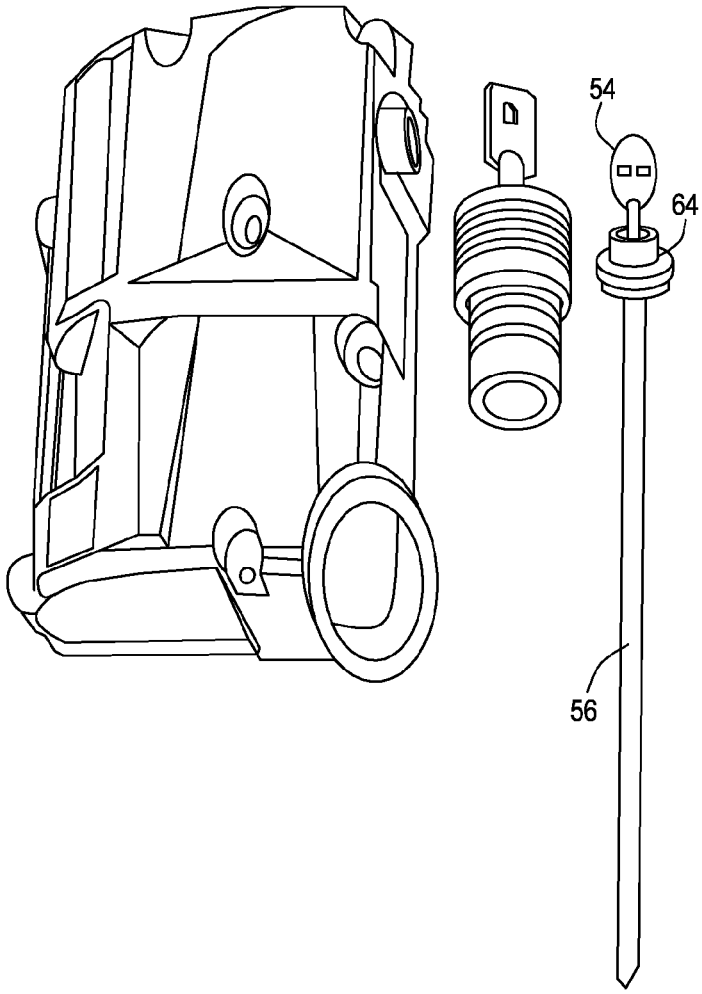
FIG. 6 shows another embodiment of the crank case oil cap in accordance with the principles of the invention.

Referring to FIG. 6, there is shown another embodiment of the crank case oil cap in accordance with the principles of the invention. In this embodiment the third member is not pressed fit into the second member, it has a sloppy fit with the second member and the O ring 64 provides a seal between the second member and the third member. In use, the friction of the O ring against the side wall of the second member is normally sufficient to hold the third member in the second member as the cap is removed from the engine.

While there have been shown and described and pointed out the fundamental novel features of the invention as applied to the preferred embodiments, it will be understood that various omissions and substitutions and changes of the form and details of the apparatus illustrated and in the operation may be done by those skilled in the art, without departing from the spirit of the invention.

What is claimed is:

1. A locking cap for closing the opening for receiving oil in a crank case, said cap comprising:

a first member having an upper grip portion and a lower portion;

openings located in said lower portion of said first member for holding ball bearings;

a second member rotatably coupled to said first member; and a lock mechanism attached to said first and second members to rotate said second member relative to said first member; wherein said second member urges said ball bearings to move through said openings in said first member as said second member is rotated in a first direction relative to said first member.

2. The locking cap of claim 1 wherein said openings in said first member are square.

3. The locking cap of claim 1 wherein said openings are rectangular.

4. The locking cap of claim 2 wherein each opening has a size that allows a ball bearing to pass only partially thru the opening.

5. The locking cap of claim 3 wherein each opening has at least one dimension that allows a ball bearing to pass only partially thru the opening.

6. The locking cap of claim 1 wherein said first member supports at least one O ring located between the upper grip portion and the openings located in lower portion of the first member.

7. The locking cap of claim 1 wherein said second member supports a flange at one end and an O ring at the other end to provide an oil seal between said first and second members.

8. The locking cap of claim 1 wherein the flange of said second member abuts the end of the first member.

9. The locking cap of claim 1 wherein the flange of the second member forms a bottom of the openings located in said first member.

10. The locking cap of claim 9 wherein the second member has a ramp that is aligned with each opening for urging the ball bearing in each opening to move partially thru an opening as the second member is rotated relative to the firs member.

11. The locking cap of claim 1 wherein a third member is coupled to said second member with a flange that is positioned within said second member; and the third member is coupled to a dip stick.

12. The locking cap of claim 11 wherein said third member is pressed fit to said second member.

13. The locking cap of claim 12 wherein an O ring is located in a groove in the flange of said third member.

14. The locking cap of claim 11 wherein said third member makes a sloppy fit with said second member.

15. The locking cap of claim 14 wherein an O ring is located in a groove in the flange of said third member.

16. The locking cap of claim 1 wherein said second member is attached to the lock mechanism with a nut.

17. The locking cap of claim 16 wherein said lock mechanism rotates said second member relative to said first member when the lock mechanism is operated.

18. The locking cap of claim 16 wherein said lock mechanism is a cam lock.

* * * * *